US010814356B2

(12) United States Patent
Xin et al.

(10) Patent No.: US 10,814,356 B2
(45) Date of Patent: Oct. 27, 2020

(54) CLEANING SYSTEM FOR A POLISHING FILM

(71) Applicants: Tyco Electronics (Shanghai) Co. Ltd., Shanghai (CN); TE Connectivity Corporation, Berwyn, PA (US); Innogetic Technology Co., Ltd., Zuhai (CN)

(72) Inventors: Liming Xin, Shanghai (CN); Yun Liu, Shanghai (CN); Fengchun Xie, Shanghai (CN); Dandan Zhang, Shanghai (CN); Roberto Francisco-Yi Lu, Berwyn, PA (US); Lei Zhou, Shanghai (CN); Kok Wai Wong, Zhuhai (CN)

(73) Assignees: Tyco Electronics (Shanghai) Co. Ltd., Shanghai (CN); TE Connectivity Corporation, Berwyn, PA (US); Innogetic Technology Co. Ltd., Zhuhai (CN)

( * ) Notice: Subject to any disclaimer, the term of this patent is extended or adjusted under 35 U.S.C. 154(b) by 133 days.

(21) Appl. No.: 15/980,906

(22) Filed: May 16, 2018

(65) Prior Publication Data

US 2018/0257112 A1 Sep. 13, 2018

Related U.S. Application Data

(63) Continuation of application No. PCT/IB2016/055543, filed on Sep. 16, 2016.

(30) Foreign Application Priority Data

Sep. 16, 2015 (CN) ..... 2015 1 0589656

(51) Int. Cl.
*B08B 1/00* (2006.01)
*B08B 1/04* (2006.01)
(Continued)

(52) U.S. Cl.
CPC ..... *B08B 1/007* (2013.01); *B08B 1/002* (2013.01); *B08B 1/04* (2013.01); *B08B 3/02* (2013.01);
(Continued)

(58) Field of Classification Search
CPC . B24B 53/017; H01L 21/02041–02043; H01L 21/02057–0206;
(Continued)

(56) References Cited

U.S. PATENT DOCUMENTS 4,476,601 A 10/1984 Oka
5,690,544 A 11/1997 Sakurai
(Continued)

FOREIGN PATENT DOCUMENTS

EP 0718871 A2 6/1996
EP 0718871 A3 11/1996
JP 786218 A 3/1995

OTHER PUBLICATIONS

PCT Notification of Transmittal, the International Seach Report and the Written Opinion of the International Searching Authority, or the Declaration, dated Dec. 1, 2016, 14 pages.

*Primary Examiner* — Spencer E Bell
(74) *Attorney, Agent, or Firm* — Barley Snyder

(57) ABSTRACT

A cleaning system comprises a first cleaning tank, a carrying and moving unit, a first cleaning spray head, and a rolling brush unit. The carrying and moving unit is configured to move a polishing film to be cleaned into the first cleaning tank and hold the polishing film in the first cleaning tank. The first cleaning spray head is configured to spray a cleaning liquid on the polishing film held in the first cleaning tank. The rolling brush unit is configured to brush the polishing film while the first cleaning spray head sprays the cleaning liquid on the polishing film.

20 Claims, 3 Drawing Sheets

(51) Int. Cl.

| | |
|---|---|
| ***B08B 3/02*** | (2006.01) |
| ***B24B 53/017*** | (2012.01) |
| ***B24B 53/02*** | (2012.01) |
| ***B08B 5/02*** | (2006.01) |

(52) U.S. Cl.
CPC ..... *B08B 5/02* (2013.01); *B24B 53/017* (2013.01); *B24B 53/02* (2013.01)

(58) Field of Classification Search
CPC ..... H01L 21/02068–02096; H01L 21/67028–67057
See application file for complete search history.

(56) References Cited

U.S. PATENT DOCUMENTS

| | | | | |
|---|---|---|---|---|
| 5,806,137 | A * | 9/1998 | Ishi | B08B 1/007 15/302 |
| 6,634,934 | B1 * | 10/2003 | Akaike | B24B 53/017 451/287 |
| 6,645,053 | B1 * | 11/2003 | Kimura | B24B 53/017 451/286 |
| 2001/0027797 | A1 * | 10/2001 | Yoshioka | B08B 1/02 134/1 |
| 2001/0029150 | A1 * | 10/2001 | Kimura | B24B 9/065 451/41 |
| 2003/0216112 | A1 | 11/2003 | Gotze et al. | |
| 2014/0311532 | A1 * | 10/2014 | Yokoyama | H01L 21/67046 134/33 |

* cited by examiner

CLEANING SYSTEM FOR A POLISHING FILM

CROSS-REFERENCE TO RELATED APPLICATIONS

This application is a continuation of PCT International Application No. PCT/IB2016/055543, filed on Sep. 16, 2016, which claims priority under 35 U.S.C. § 119 to Chinese Patent Application No. 201510589656.6, filed on Sep. 16, 2015.

FIELD OF THE INVENTION

The present invention relates to a cleaning system and, more particularly, to a cleaning system for cleaning a polishing powder dust from a used polishing film.

BACKGROUND

A fiber optic connector generally comprises a housing and a fiber optic ferrule mounted in the housing. The fiber optic ferrule has a ferrule and an optical fiber inserted into a bore of the ferrule. A front end of the optical fiber protrudes from a front end face of the ferrule by a predetermined distance. The optical fiber is fixed in the bore of the ferrule by an adhesive filled in the bore of the ferrule.

After the optical fiber is fixed in the bore of the ferrule, the front end face of the fiber optic ferrule is processed. The processing of the front end face of the fiber optic ferrule generally includes polishing the front end face of the fiber optic ferrule, cleaning the polished fiber optic ferrule to remove the polishing powder from the fiber optic ferrule, drying the cleaned fiber optic ferrule, and wiping the front end face of the dried fiber optic ferrule to remove dust from the front end face of the fiber optic ferrule.

After a polishing film used to perform the polishing becomes dirty, the polishing film can be cleaned to remove an accumulated polishing powder dust, and can then be reused. The cleaning of the used polishing film is generally performed manually and is therefore inefficient and ineffective, as it is difficult to completely remove the polishing powder dust from the polishing film.

SUMMARY

A cleaning system comprises a first cleaning tank, a carrying and moving unit, a first cleaning spray head, and a rolling brush unit. The carrying and moving unit is configured to move a polishing film to be cleaned into the first cleaning tank and hold the polishing film in the first cleaning tank. The first cleaning spray head is configured to spray a cleaning liquid on the polishing film held in the first cleaning tank. The rolling brush unit is configured to brush the polishing film while the first cleaning spray head sprays the cleaning liquid on the polishing film.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
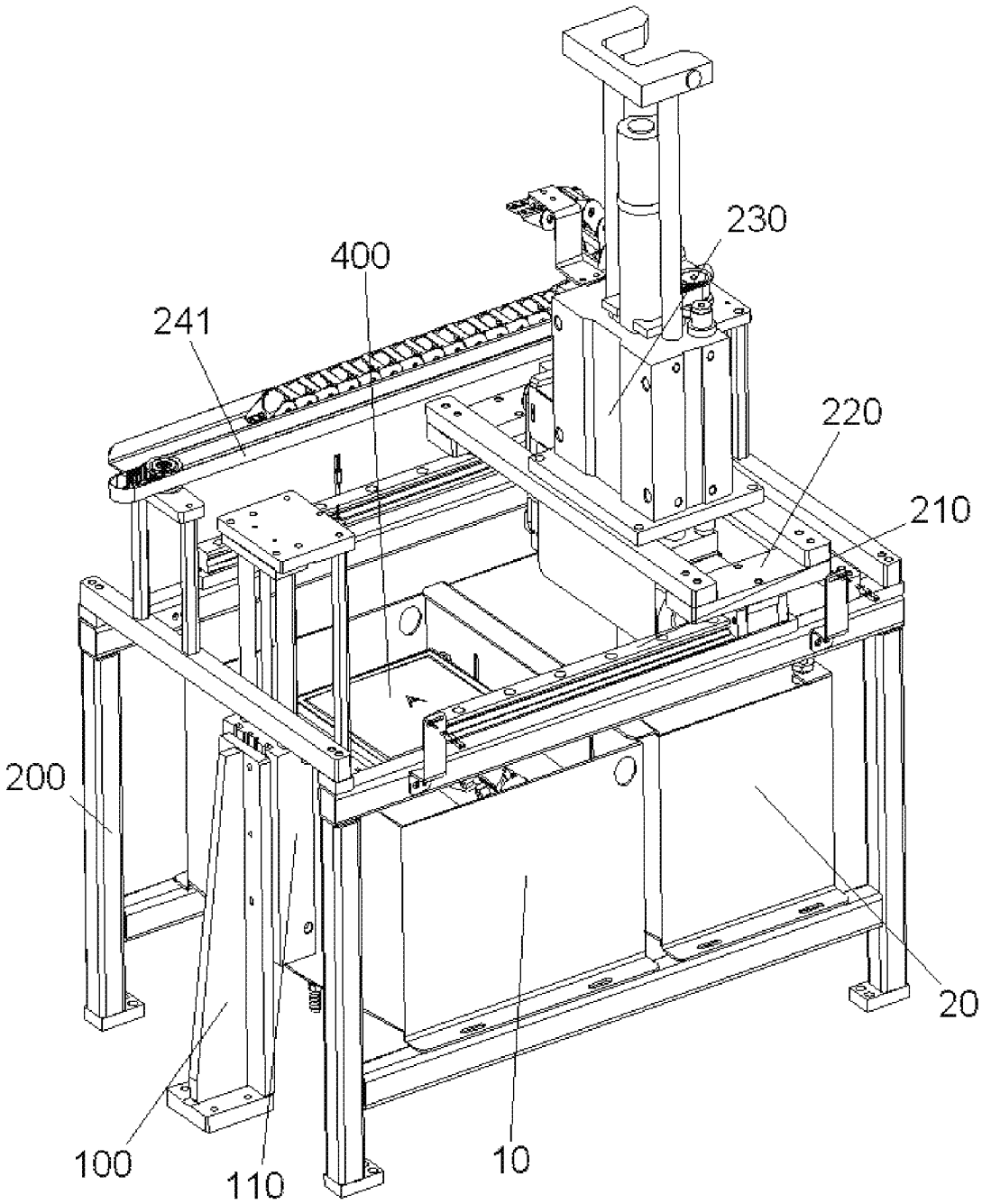
FIG. 1 is a perspective view of a cleaning system according to an embodiment.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will be thorough and complete and will fully convey the concept of the disclosure to those skilled in the art.

Figure 2:
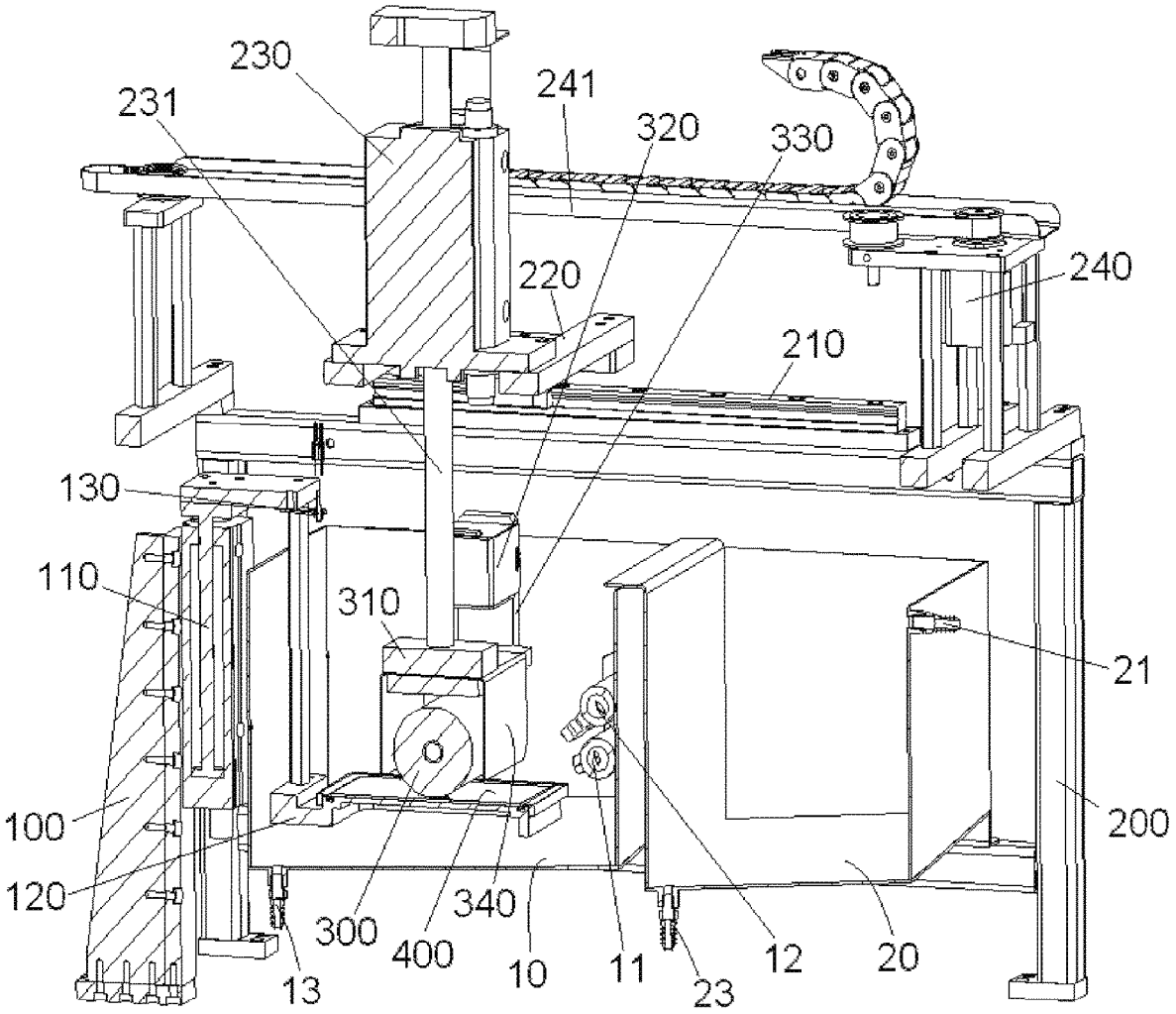
FIG. 2 is a sectional view of the cleaning system with a rolling brush in a first cleaning tank of the cleaning system.
Figure 3:
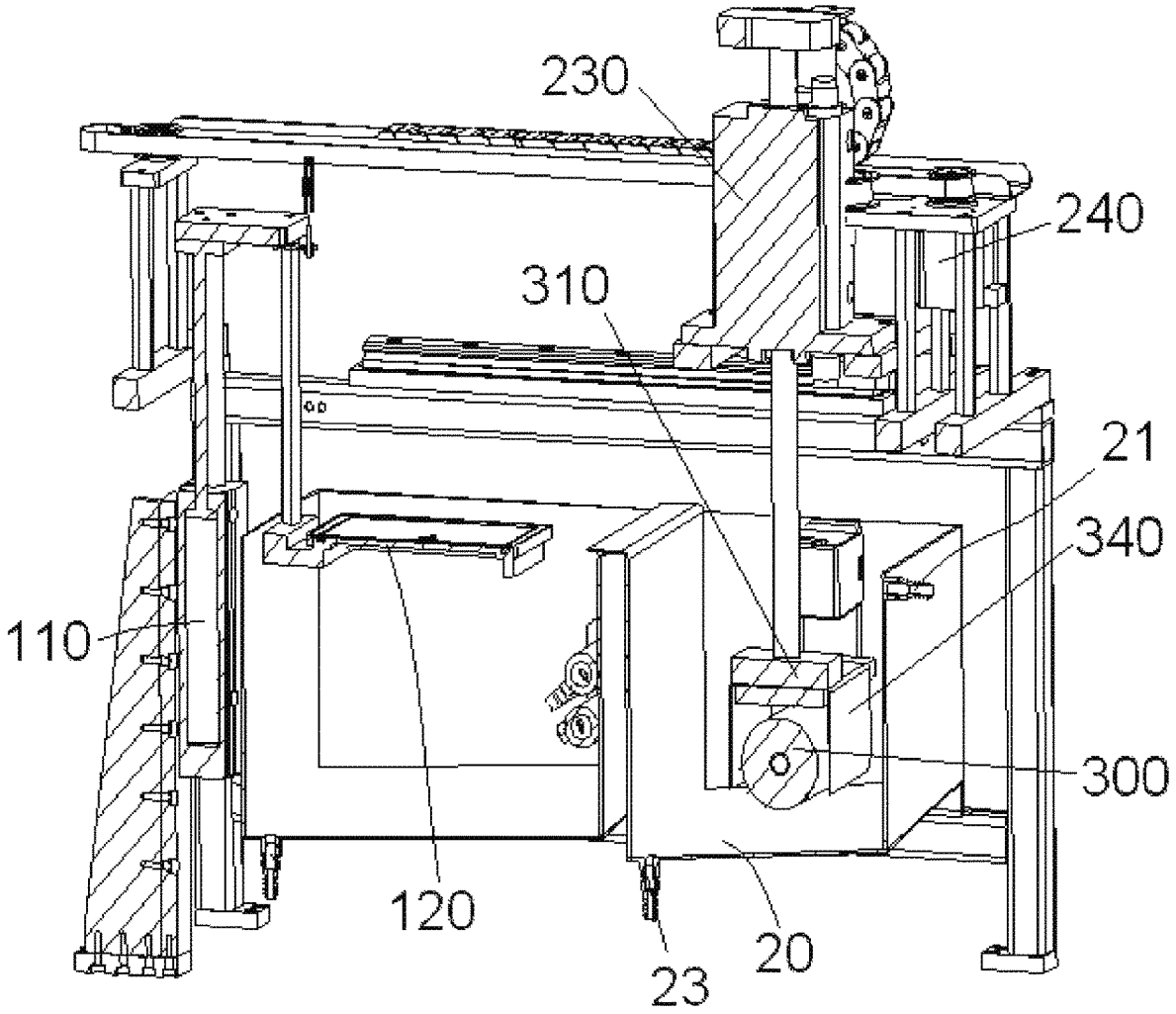
FIG. 3 is a sectional view of the cleaning system with the rolling brush in a second cleaning tank of the cleaning system.

A cleaning system according to an embodiment is shown in FIGS. 1-3. The cleaning system is adapted to clean off a polishing powder dust from a used polishing film 400. The cleaning system comprises a first cleaning tank 10, a carrying and moving unit, a first cleaning spray head 11, and a rolling brush unit.

The carrying and moving unit is configured to move the used polishing film 400 to be cleaned into the first cleaning tank 10 and hold the polishing film 400 in the first cleaning tank 10. The first cleaning spray head 11 is configured to spray a cleaning liquid to the polishing film 400 held in the first cleaning tank 10. The rolling brush unit is configured to brush the polishing film 400 while the first cleaning spray head 11 is spraying the cleaning liquid on the polishing film 400.

The carrying and moving unit, as shown in FIGS. 1 and 2, comprises a carrying table 120 adapted to load the polishing film 400 thereon, a lifting mechanism 110 adapted to move the carrying table 120 into the first cleaning tank 10, and a support frame 100 configured to support the lifting mechanism 110 and the carrying table 120.

In the embodiment shown in FIGS. 1 and 2, the carrying and moving unit comprises a sensor 130 adapted to detect both whether the polishing film 400 is placed on the carrying table 120 and to detect a state of the polishing film 400 on the carrying table 120. The state of the polishing film 400 may include the position and/or the posture of the polishing film 400 on the carrying table 120.

As shown in FIGS. 1 and 2, the lifting mechanism 110 is mounted on the support frame 100. The carrying table 120 is mounted on the lifting mechanism 110 and configured to move up and down with the lifting mechanism 110 along a vertical direction. The sensor 130 is mounted on the lifting mechanism 110. The lifting mechanism 110 comprises an installation frame on which the carrying table 120 and the sensor 130 are mounted and a driver mounted on the support frame 100 and adapted to drive the installation frame to move up and down in the vertical direction. In an exemplary embodiment, the driver of the lifting mechanism 110 is a gas cylinder or a hydraulic cylinder.

The rolling brush unit, as shown in FIGS. 1 and 2, comprises a rolling brush installation frame 310, a rolling brush 300 rotatably mounted on the rolling brush installation frame 310, a rolling brush driver 320 adapted to drive the rolling brush 300 to rotate about its axis, a horizontal moving mechanism configured to move the rolling brush 300 fore and aft in a horizontal direction, a vertical moving mechanism configured to move the rolling brush 300 up and down in the vertical direction, and a main support frame 200 configured to support the rolling brush 300, the rolling brush driver 320, the horizontal moving mechanism and the vertical moving mechanism.

The horizontal moving mechanism, as shown in FIGS. 1 and 2, comprises a horizontal rail 210 mounted on the main support frame 200, a horizontal moving table 220 slidably mounted on the horizontal rail 210, and a horizontal moving driver 240 mounted on the main support frame 200 and configured to drive the horizontal moving table 220 to move fore and aft along the horizontal rail 210. The horizontal moving driver 240 drives the horizontal moving table 220 to move fore and aft along the horizontal rail 210 using a first belt transmission mechanism 241.

The vertical moving mechanism, as shown in FIGS. 1 and 2, comprises a vertical moving driver 230 mounted on the horizontal moving table 220 and a vertical connecting shaft 231 connecting the rolling brush installation frame 310 to the vertical moving driver 230. The vertical moving driver 230 is configured to move fore and aft along the horizontal rail 210 with the horizontal moving table 220. In an embodiment, the vertical moving driver 230 is a gas cylinder or a hydraulic cylinder. The vertical moving driver 230 may lift up or lower down the rolling brush installation frame 310 in the vertical direction via the vertical connecting shaft 231.

The rolling brush driver 320, shown in FIGS. 1 and 2, is configured to drive the rolling brush 300 to rotate about its axis using a second belt transmission mechanism 330. In an embodiment, the rolling brush driver 320 is a motor. In the embodiment shown in FIGS. 1 and 2, two protection plates 340 are provided at a front side and a rear side of the rolling brush 300 in a direction parallel to the horizontal rail 210, respectively, so as to prevent the cleaning liquid from being splashed outward from the front and rear sides of the rolling brush 300.

The cleaning system comprises a gas spray head 12 adapted to spray a gas to the cleaned polishing film 400 to dry the polishing film 400. In the embodiment shown in FIGS. 1 and 2, the first cleaning spray head 11 and the gas spray head 12 are mounted in the first cleaning tank 10. A first drain outlet 13 is formed in a bottom of the first cleaning tank 10, so as to drain waste cleaning liquid out of the first cleaning tank 10.

The rolling brush 300, as shown in FIG. 3, can be cleaned in a second cleaning tank 20 of the cleaning system. A second cleaning spray head 21 is mounted in the second cleaning tank 20. The horizontal moving mechanism and the vertical moving mechanism cooperate with each other to move the rolling brush 300 to be cleaned, which is used and dirty, into the second cleaning tank 20. The second cleaning spray head 21 is adapted to spray a cleaning liquid to the rolling brush 300 in the second cleaning tank 20 to clean the rolling brush 300. A second drain outlet 23 is formed in a bottom of the second cleaning tank 20 to drain waste cleaning liquid out of the second cleaning tank 20.

A cleaning process of the cleaning system will now be described with reference to FIGS. 1-3.

A dirty polishing film 400 to be cleaned is first held on the carrying table 120. Then, the carrying table 120 and the polishing film 400 held on the carrying table 120 are lowered and moved into the first cleaning tank 10 using the lifting mechanism 110, as shown in FIG. 2.

The rolling brush 300 is the moved into the first cleaning tank 10 using the horizontal moving mechanism and the vertical moving mechanism. The rolling brush 300 is moved into contact with the polishing film 400 on the carrying table 120. The first cleaning spray head 11 is opened and the rolling brush driver 320 and the horizontal moving driver 240 are then turned on, driving the rolling brush 300 to rotate about its axis and move fore and aft along a horizontal surface of the polishing film 400 while the first cleaning spray head 11 sprays the cleaning liquid to the polishing film 400, removing a polishing powder dust from the polishing film 400.

After the polishing film 400 has been cleaned, the gas spray head 12 is opened to spray the gas to the cleaned polishing film 400 and dry the polishing film 400.

After the polishing film 400 is dried, the rolling brush 300 is moved into the second cleaning tank 20 using the horizontal moving mechanism and the vertical moving mechanism as shown in FIG. 3. The carrying table 120 and the cleaned and dried polishing film 400 held on the carrying table 120 are then lifted out of the first cleaning tank 10 using the lifting mechanism 110. Finally, the second cleaning spray head 21 is opened to spray a cleaning liquid to the rolling brush 300 to be cleaned in the second cleaning tank 20 and clean off the polishing powder dust from the rolling brush 300.

What is claimed is:

1. A cleaning system, comprising:

a first cleaning tank;

a carrying and moving unit including a lifting mechanism, a driver of the lifting mechanism configured to lower a polishing film to be cleaned into the first cleaning tank and hold the polishing film in the first cleaning tank during cleaning;

a first cleaning spray head configured to spray a cleaning liquid on the polishing film held in the first cleaning tank; and a rolling brush unit configured to brush the polishing film while the first cleaning spray head sprays the cleaning liquid on the polishing film, the rolling brush unit comprising a horizontal moving mechanism including:

a horizontal moving driver; and a horizontal moving table slidably mounted on a horizontal rail, wherein the horizontal moving driver is configured to drive the horizontal moving table to move fore and aft in a horizontal direction along the horizontal rail.

2. The cleaning system of claim 1, wherein the carrying and moving unit further comprises:

a carrying table on which the polishing film is disposed; and a support frame configured to support the lifting mechanism and the carrying table.

3. The cleaning system of claim 2, wherein the carrying and moving unit comprises a sensor adapted to detect whether the polishing film is on the carrying table and to detect a state of the polishing film on the carrying table.

4. The cleaning system of claim 3, wherein the lifting mechanism is mounted on the support frame.

5. The cleaning system of claim 4, wherein the carrying table is mounted on the lifting mechanism and configured to move up and down with the lifting mechanism along a vertical direction.

6. The cleaning system of claim 5, wherein the sensor is mounted on the lifting mechanism.

7. The cleaning system of claim 6, wherein the lifting mechanism comprises an installation frame on which the carrying table and the sensor are mounted, and wherein the driver of the lifting mechanism is mounted on the support frame and adapted to drive the installation frame to move up and down in the vertical direction.

8. The cleaning system of claim 1, wherein the rolling brush unit further comprises:

a rolling brush installation frame;

a rolling brush rotatably mounted on the rolling brush installation frame;

a rolling brush driver adapted to drive the rolling brush to rotate about an axis of the rolling brush;

a vertical moving mechanism including a vertical moving driver and configured to move the rolling brush up and down in the vertical direction; and a main support frame configured to support the rolling brush, the rolling brush driver, the horizontal moving mechanism, and the vertical moving mechanism.

9. The cleaning system of claim 8, wherein the vertical moving driver is mounted on the horizontal moving table and configured to move fore and aft along the horizontal rail with the horizontal moving table, and the vertical moving mechanism further comprises a vertical connecting shaft connecting the rolling brush installation frame to the vertical moving driver.

10. The cleaning system of claim 9, wherein the vertical moving driver is adapted to move the rolling brush installation frame up and down in the vertical direction via the vertical connecting shaft.

11. The cleaning system of claim 10, wherein the rolling brush driver is configured to drive the rolling brush to rotate about the axis of the rolling brush with a second belt transmission mechanism.

12. The cleaning system of claim 11, further comprising a pair of protection plates mounted to the rolling brush installation frame, one of the pair of protection plates is disposed at each of a front side and a rear side of the rolling brush.

13. The cleaning system of claim 8, further comprising a second cleaning tank, the rolling brush is moved into the second cleaning tank by the horizontal moving mechanism and the vertical moving mechanism.

14. The cleaning system of claim 13, further comprising a second cleaning spray head mounted in the second cleaning tank, the second cleaning spray head configured to spray the cleaning liquid on the rolling brush held in the second cleaning tank.

15. The cleaning system of claim 14, wherein the second cleaning tank has a second drain outlet in a bottom of the second cleaning tank.

16. The cleaning system of claim 1, wherein the horizontal moving driver is configured to drive the horizontal moving table to move fore and aft along the horizontal rail with a first belt transmission mechanism.

17. The cleaning system of claim 1, further comprising a gas spray head adapted to spray a gas on the polishing film to dry the polishing film.

18. The cleaning system of claim 17, wherein the first cleaning spray head and the gas spray head are mounted to an interior wall of the first cleaning tank.

19. The cleaning system of claim 1, wherein the first cleaning tank has a first drain outlet in a bottom of the first cleaning tank.

20. A cleaning system, comprising:

a first cleaning tank;

a carrying and moving unit including a lifting mechanism, a driver of the lifting mechanism configured to lower a polishing film to be cleaned into the first cleaning tank and hold the polishing film in the first cleaning tank during cleaning;

a first cleaning spray head configured to spray a cleaning liquid on the polishing film held in the first cleaning tank; and a rolling brush unit configured to brush the polishing film while the first cleaning spray head sprays the cleaning liquid on the polishing film, the rolling brush unit comprising:

a horizontal moving mechanism including a horizontal moving table and a horizontal moving driver for driving the horizontal moving table to move fore and aft in a horizontal direction relative to the polishing film; and a vertical moving mechanism including a vertical moving driver mounted on the horizontal moving table and configured to move fore and aft along with the horizontal moving table, and to move the rolling brush up and down in the vertical direction.

* * * * *